US010001120B2

(12) United States Patent
Hoban et al.

(10) Patent No.: US 10,001,120 B2
(45) Date of Patent: Jun. 19, 2018

(54) LIGHTWEIGHT COMPRESSOR CRANKCASE ASSEMBLY AND METHOD

(71) Applicant: Bendix Commercial Vehicle Systems LLC, Elyria, OH (US)

(72) Inventors: Edward F. Hoban, Cleveland, OH (US); Gilles Hebrard, Lisieux (FR)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 160 days.

(21) Appl. No.: 14/880,191

(22) Filed: Oct. 9, 2015

(65) Prior Publication Data

US 2017/0058889 A1 Mar. 2, 2017

Related U.S. Application Data

(60) Provisional application No. 62/212,545, filed on Aug. 31, 2015.

(51) Int. Cl.

| | |
|---|---|
| ***F04B 53/16*** | (2006.01) |
| ***F04B 39/06*** | (2006.01) |
| ***F04B 39/12*** | (2006.01) |
| ***F04B 39/14*** | (2006.01) |

(52) U.S. Cl.

CPC ..... *F04B 53/168* (2013.01); *F04B 39/06* (2013.01); *F04B 39/064* (2013.01); *F04B 39/126* (2013.01); *F04B 39/127* (2013.01); *F04B 39/128* (2013.01); *F04B 39/14* (2013.01); *F05B 2230/60* (2013.01); *F05B 2240/14* (2013.01); *F05B 2280/1011* (2013.01); *F05B 2280/1073* (2013.01); *F05B 2280/40* (2013.01)

(58) Field of Classification Search

CPC ..... F04B 53/168; F04B 39/06; F04B 39/126; F04B 39/127; F04B 39/128; F04B 39/14

USPC ..... 92/169.1

See application file for complete search history.

(56) References Cited

U.S. PATENT DOCUMENTS

| | | | | |
|---|---|---|---|---|
| 2,792,790 A | | 5/1957 | Capps | |
| 4,101,137 A | | 7/1978 | Travis | |
| 4,911,109 A | * | 3/1990 | Kawamura | F01P 3/02 123/193.3 |
| 4,999,912 A | | 3/1991 | Cuccato | |

(Continued)

FOREIGN PATENT DOCUMENTS

| | | | |
|---|---|---|---|
| CN | 102839303 A | * | 12/2012 |
| CN | 20317579 U | | 9/2013 |

(Continued)

OTHER PUBLICATIONS

Machine Translation of CN 102839303A.*

(Continued)

*Primary Examiner* — F. Daniel Lopez
*Assistant Examiner* — Daniel Collins
(74) *Attorney, Agent, or Firm* — Cheryl L. Greenly; Brian E. Kondas; Eugene E. Clair

(57) ABSTRACT

A compressor crankcase assembly is provided for an air compressor. In one example, a compressor crankcase assembly includes a crankcase made of a material comprising at least 50% by weight aluminum and a crankcase liner disposed within the crankcase. The crankcase has a protrusion that is at least partially disposed within the groove of the crankcase liner.

24 Claims, 5 Drawing Sheets

(56) References Cited

U.S. PATENT DOCUMENTS

| | | | | |
|---|---|---|---|---|
| 6,668,702 | B2 * | 12/2003 | Sud | F04B 39/126 92/171.1 |
| 6,799,541 | B1 * | 10/2004 | Clinton | F02F 1/16 123/41.84 |
| 8,147,215 | B2 | 4/2012 | Rigel et al. | |
| 8,371,828 | B2 | 2/2013 | Hebrard et al. | |
| 2008/0219868 | A1 * | 9/2008 | Bonniface | F04B 35/045 417/415 |
| 2014/0318516 | A1 * | 10/2014 | Edmo | C22C 37/04 123/668 |

FOREIGN PATENT DOCUMENTS

| | | | |
|---|---|---|---|
| DE | 102009011214 | A1 | 9/2010 |
| EP | 0229214 | | 10/1989 |
| FR | 948008 | A | 7/1949 |
| GB | 658118 | A | 10/1951 |
| GB | 2080441 | A | 2/1982 |

OTHER PUBLICATIONS

International Search Report, European Patent Office, dated Nov. 16, 2016, pp. 1-13.

Bendix, Bendix Service Data SD-02-4525, Bendix(R)EverSure(R) Spring Brake with No Touch(TM) Technology, May 2015, pp. 1-8.

Henkel Material Safety Data Sheet—Locktite 640 R. C. ML EN; 2010, pp. 1-5.

* cited by examiner

LIGHTWEIGHT COMPRESSOR CRANKCASE ASSEMBLY AND METHOD

CROSS-REFERENCE TO RELATED APPLICATION

This application claims the benefit of U.S. Provisional Application No. 62/212,545 ("Priority Application"), entitled "Lightweight Compressor Crankcase Assembly and Method" filed Aug. 31, 2015, the entire content of which is incorporated herein by reference.

BACKGROUND

The present invention relates to a compressor crankcase assembly and a method for making or assembling the crankcase assembly. More specifically, the present invention relates to a compressor crankcase assembly for a pneumatic air brake system and a method of making the compressor crankcase assembly. Crankcase assemblies used in compressors have components such as a crankcase and piston which are traditionally made of cast iron. An example of such a compressor design may include the design of a Bendix® BA-921® Compressor commercially available from Bendix Commercial Vehicle Systems LLC located in Elyria, Ohio. More recently, however, some compressor crankcases are made of aluminum to reduce the weight of the compressor and to save energy in transportation. Cast aluminum crankcases allow for reduction in weight; however, the specific heat and the heat capacity of aluminum are much greater than that of traditional crankcase materials. Therefore, proper cooling remains a challenge to dissipate the heat generated by compressors, particularly in crankcase assemblies that have components made of aluminum or aluminum alloys.

SUMMARY

Various examples of a lightweight compressor crankcase assembly are disclosed. In accordance with one aspect, a compressor crankcase assembly includes a crankcase made of a material comprising at least 50% by weight aluminum and a crankcase liner disposed within the crankcase. The crankcase has a protrusion that is at least partially disposed within a groove along an outer surface of the crankcase liner.

In another aspect of the present invention, a method for producing a crankcase assembly includes: forming a groove in the outer surface of crankcase liner; heating the crankcase made of a material that comprises at least about 50% by weight aluminum; placing the crankcase liner into the opening of the crankcase such that the outer surface of the crankcase is placed into contact with the inner surface of the crankcase; and forming a protrusion on the outer surface of the crankcase such that the protrusion contacts the groove of the crankcase liner.

BRIEF DESCRIPTION OF THE DRAWINGS

In the accompanying drawings which are incorporated in and constitute a part of the specification, examples of the invention are illustrated, which, together with a general description of the invention given above, and the detailed description given below, serve to exemplify aspects of this invention. The components in the drawings are not necessarily to scale. Also, in the drawings, like reference numerals designate corresponding parts throughout the several views.

DETAILED DESCRIPTION

Figure 1:
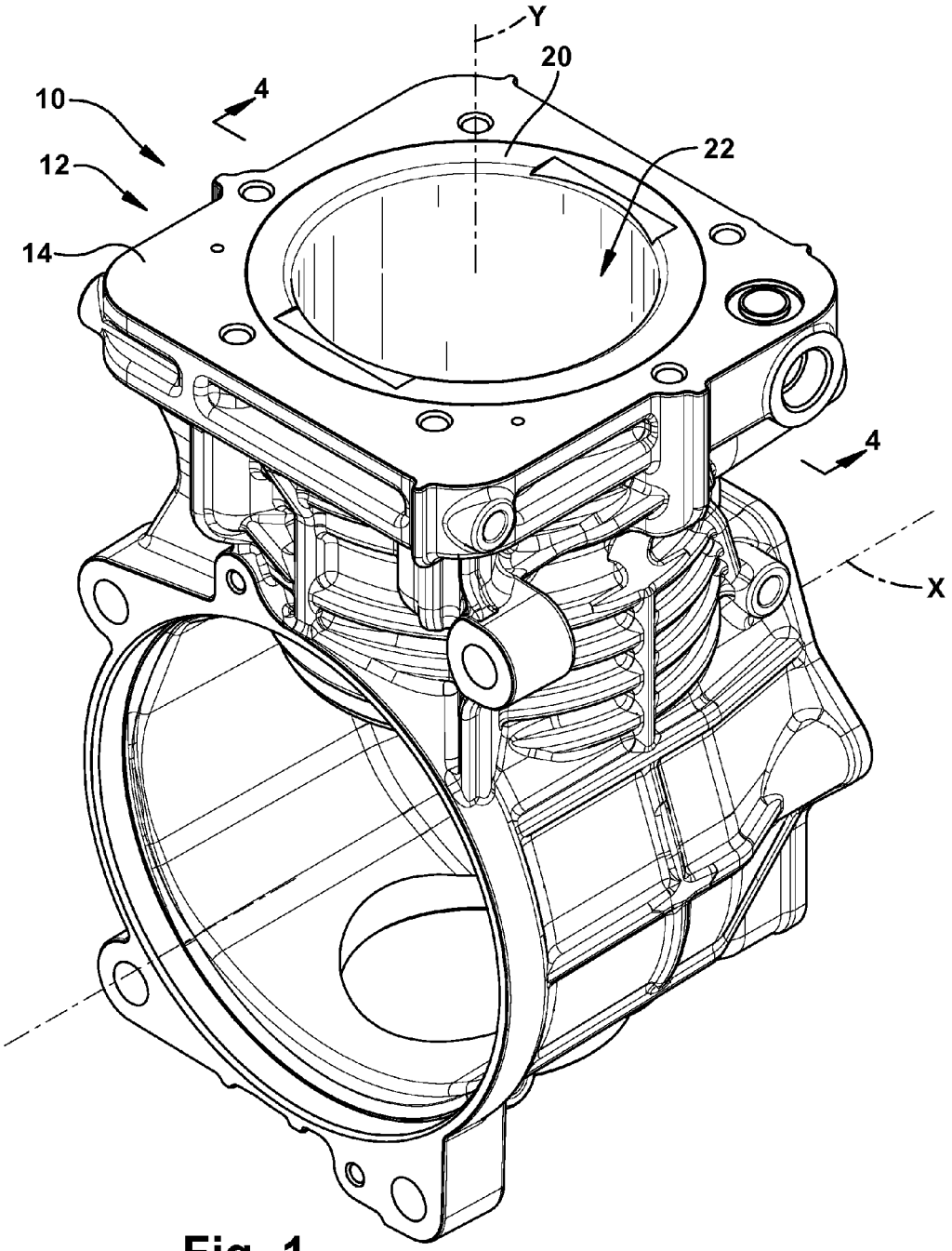
FIG. 1 is a perspective view of a compressor crankcase assembly, according to an example of the present invention.

Aspects of the present invention are directed to a compressor crankcase assembly, such as that used in a truck vehicle or other commercial vehicles. Although the examples explained herein relate to a compressor crankcase assembly on trucks or other commercial vehicles with pneumatic brake systems, it is understood that the example crankcase assemblies described herein, can be used in alternative applications. In addition, although the examples explained herein often relate to air compressors, it is understood that reciprocating compressors can be used in alternative applications. FIG. 1 illustrates a perspective view of a compressor crankcase assembly 10 according to an aspect of the present invention. Compressor crankcase assembly 10 includes crankcase 12 having crankcase flange 14 onto which a valve plate (not shown) is seated. Crankcase assembly 10 also includes crankcase liner 20 which defines a central opening 22 centered about vertical axis, Y, in which a piston (not shown) resides. Compressors, for example a reciprocating compressor used in a truck air brake system includes several components (not shown), including but not limited to, a crankshaft, piston, valve plate, cylinder head and safety valve, in addition to the crankcase assembly shown in FIGS. 1 and 2.

Figure 2:
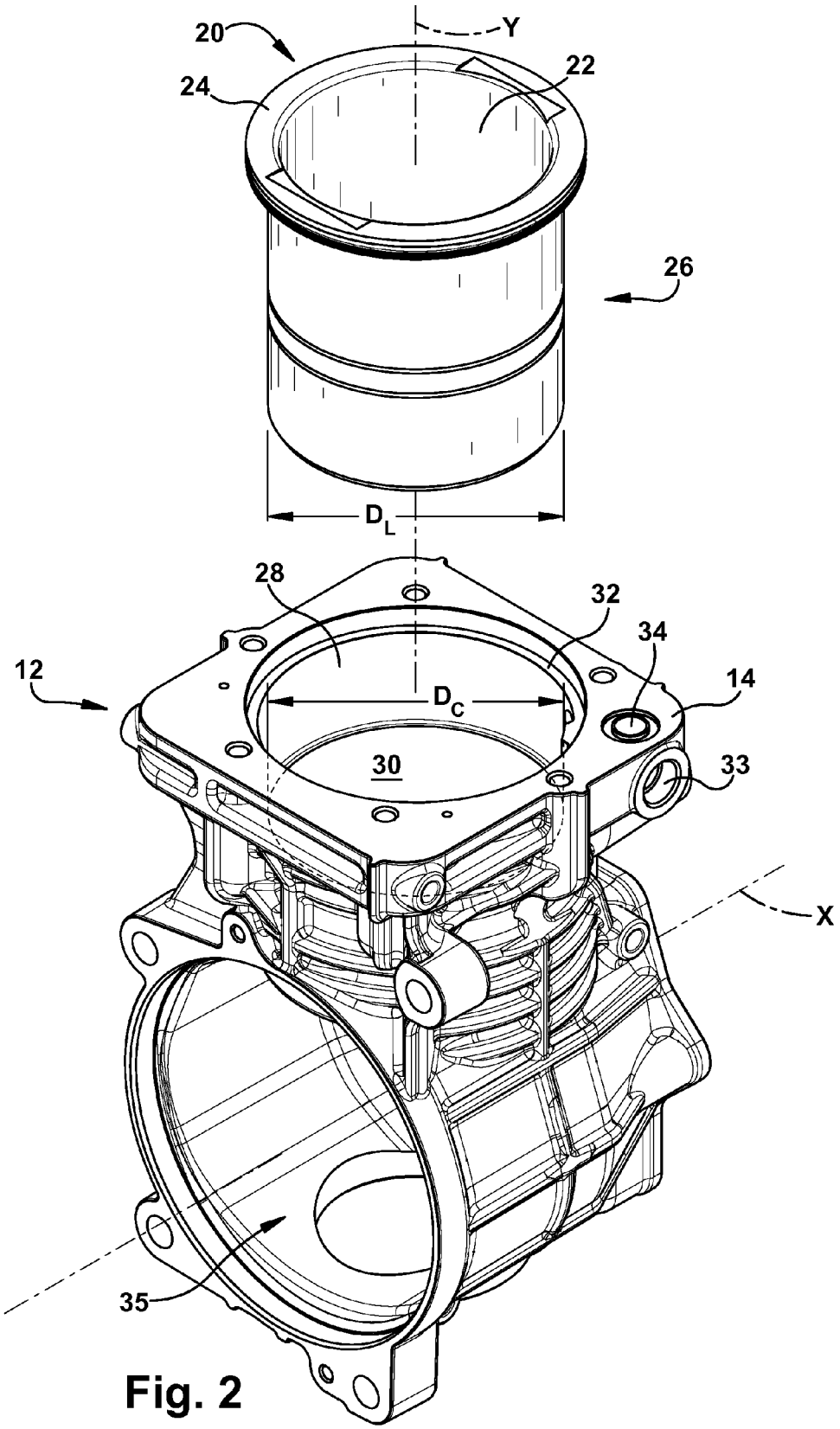
FIG. 2 is an exploded view of the compressor crankcase assembly of FIG. 1, according to an example of the present invention.

Referring to FIG. 2, an exploded perspective view of a pre-assembled crankcase assembly 10 of FIG. 1 is illustrated. Crankcase liner 20 includes flange 24 and liner body 26. Crankcase 12 defines a central opening 28 or bore and inner surface 30 centered about a vertical axis, Y, and through which the liner 20 extends. Liner body 26 is substantially cylindrical in shape, although other shapes may be used and typically correspond to the geometry of the piston (not shown) and inner surface 30 of crankcase 12. Shoulder or recess 32 of crankcase 12 functions as a seat or stop for the crankcase flange 24 of liner 20 when liner is positioned in crankcase (FIG. 1). The diameter of crankcase opening 28, $D_C$, changes during assembly. The outer diameter of liner body 26, $D_L$, is greater than the diameter of crankcase opening 28, $D_C$, at room temperature prior to assembly but outer diameter of liner body 26, $D_L$ expands when heated during assembly, as will be further described below.

Crankcase 12 has several ports, for example coolant port 33, which permits entrance, and exit for example through exit port 34, of liquid coolant to flow inside the crankcase 12. Examples of coolant include, but are not limited to, water, glycol, and mixtures thereof. Crankcase assembly 10 has a "wet liner" in which liquid flows between the crankcase 12 and liner 20. In crankcase assemblies having a "dry liner" fluid does not come in contact with liner 20 and fluid is routed in alternative locations of the crankcase assembly for cooling. Crankcase assembly 10 having a "wet liner" can achieve improved heat transfer performance over "dry liner" designs given the size constraints of the compressor crankcase assemblies. A "wet liner" in accordance with the various design aspects disclosed herein, allows for improved cooling of the compressor while preventing coolant leakage into the compressor oil system in the crankshaft (not shown). The crankshaft is generally located in the base or lower portion 35 of crankcase 12, with the crankshaft oriented along the X-axis below liner 20, for example.

Crankcase 12 is made of a material that comprises aluminum and in one example crankcase 12 is die cast aluminum. The crankcase material composition can vary and can be made of aluminum or an aluminum alloy. For example the crankcase material may include greater than about 50% by weight aluminum, in another example greater than about 80% aluminum, in another example greater than about 85% aluminum, and in another example greater than about 95% aluminum. A suitable material for crankcase 12, for example, is Al 8360 or Al 8380 alloy. Liner 20 is made of a material that can withstand the friction and prevent wear caused by the repetitive motion of the piston. The crankcase liner 20 can be made of a material that includes, but is not limited to, metals and metal alloys. For example the crankcase liner material may include iron or an iron alloy that has greater than about 50% by weight iron, in another example greater than about 80% iron, in another example greater than about 90% iron, and in another example greater than about 95% iron. A suitable material for crankcase liner 20, for example, is cast iron alloy GG 30 or Class 30. In another example, liner 20 can be made of an advance performing alumina powder material, such as hypereutectoid aluminium. Examples of hypereutectoid aluminium are A-S18 or A-S22UNK material grades which contain 18% and 22% silicon, respectively, sold under the tradename Dispal® by Sasol and manufactured in Brunsbüttel Germany and in Lake Charles, La., USA.

Figure 3:
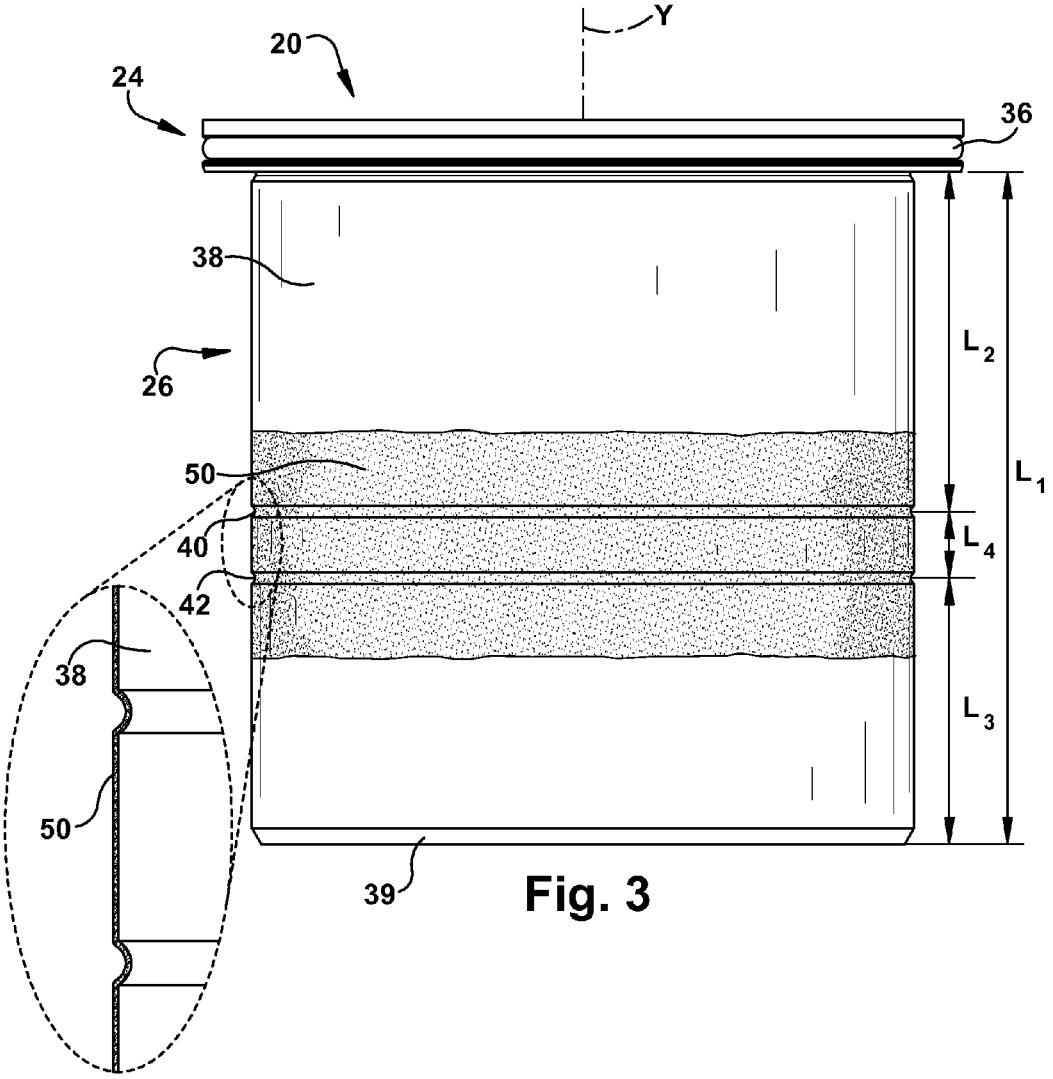
FIG. 3 is an elevation view of the crankcase liner of the compressor crankcase assembly of FIG. 1, according to an example of the present invention.

FIG. 3 is an elevation view of crankcase liner 20 illustrating details of liner flange 24 and liner body 26. A sealing device 36, for example an O-ring, is disposed in a seal cavity along the perimeter of flange 24. Sealing device 36 provides an air-tight seal between an outer diameter of liner flange 24 and the crankcase flange 14 (FIG. 1). Sealing device 36 provides an air-tight seal to prevent leakage of coolant fluid out of the crankcase assembly, for example between the crankcase 12 and the crankcase liner 20. Optionally, crankcase liner 20 includes a beveled surface 39 along its base.

Crankcase liner 20 includes groove 40, and optionally second groove 42, along the outside surface 38 of crankcase liner 20 which is substantially horizontal and perpendicular to vertical axis, Y. As shown in FIG. 3 groove 40 is circumferential about liner 20 which has a cylindrical shape, although alternative shapes are possible, for example, a rectangular or triangular shape. In one example, the size of groove 40 has a radius of about 0.25 mm (millimeters) to about 2 mm, in another example, from about 0.75 mm to about 1.25 mm, and in another example from about 0.95 mm to about 1.05 mm. The groove can have alternative profile shapes other than semicircle, for example, angled V-shaped grooves, or U-shaped with rounded or squared corners and can have a depth and width of about the same dimensions as those listed above. Grooves 40, 42, can be created in liner 20, for example, via machining, with the use of a equipment such as a CNC machine.

It has been discovered that groove 40, and optional groove 42, are located in the area of least bore distortion so that uniform contact between liner 20, made of cast iron, for example, and crankcase 12, comprising at least 50% aluminum for example, is the greatest in this area. In one aspect, groove 40 is located around the approximate center along the length, $L_1$, of liner body 26. In such case, groove 40 is located a distance $L_2$ from liner flange 24 which, in one example, is about half the distance of liner body length $L_1$, and $L_2$ is approximately equal to $L_3$. In another aspect of the present invention, crankcase liner 20 includes a second groove 42. Groove 42 can be the same dimensions and shape or different dimension and shape as groove 40. Groove 42 is located a distance L4 from groove 40 and $L_4$ can be less than $L_2$ or $L_3$, for example. In another example, $L_2$ is approximately equal to $L_3$ and grooves 40 and 42 are placed substantially equidistant from the center of liner body 26. As shown in FIG. 3 groove 40, and optionally groove 42, are circumferential about liner 20 which has a cylindrical shape. Alternative shapes of liner 20 and liner body 26 are possible, for example, such as rectangular or triangular shapes, or other shapes, depending on the geometry of the compressor crankshaft and piston. In such case the grooves 40 and 42 extend along the perimeter and outer surface 38 of the liner body 26.

In another example of the present invention, compressor crankcase assembly 10 described in any of the examples above further includes an adhesive 50. Adhesive 50 is located within groove 40, and within optional groove 42, if a second groove is present. In another example, adhesive 50 can optionally be present along outer surface 38 of liner 20 above and below groove 40 and optional groove 42. Adhesive 50 can survive harsh temperature conditions of up to about 500° F. or higher temperatures for purposes of assembling the compressor crankcase assembly as will be described. Also, for compressor crankcase assemblies as used on vehicles an adhesive should retain its adhesive properties when exposed to high and low environmental temperatures that vary greatly, for example from −40° F. to 200° F. In another example, adhesive 50 is an anaerobic adhesive that can polymerize and harden when isolated from air at an interface between the crankcase 12 and crankcase liner 20. For example, anaerobic adhesives or sealing agents typically contain acrylic polymer compounds and additives such as, peroxides, inhibitors, and curing accelerators. Examples of acrylic polymers include, but are not limited to, acrylic, acrylic acid; and methacrylates, for example polyurethane methacrylate, polyglycol dimethacrylate and hydroxyalkyl methacrylate. The absence of air gives rise to or initiates the polymerization reaction of the acrylic polymer compounds and curing takes place in the absence of oxygen and in the presence of metal ions that derive, for example, from the metallic substrate to be bonded, for example metal found in the crankcase 12 and the liner 20. A suitable adhesive is Loctite® 640™ from Henkel of America, Inc. of Rocky Hill, Conn., USA.

Figure 4:
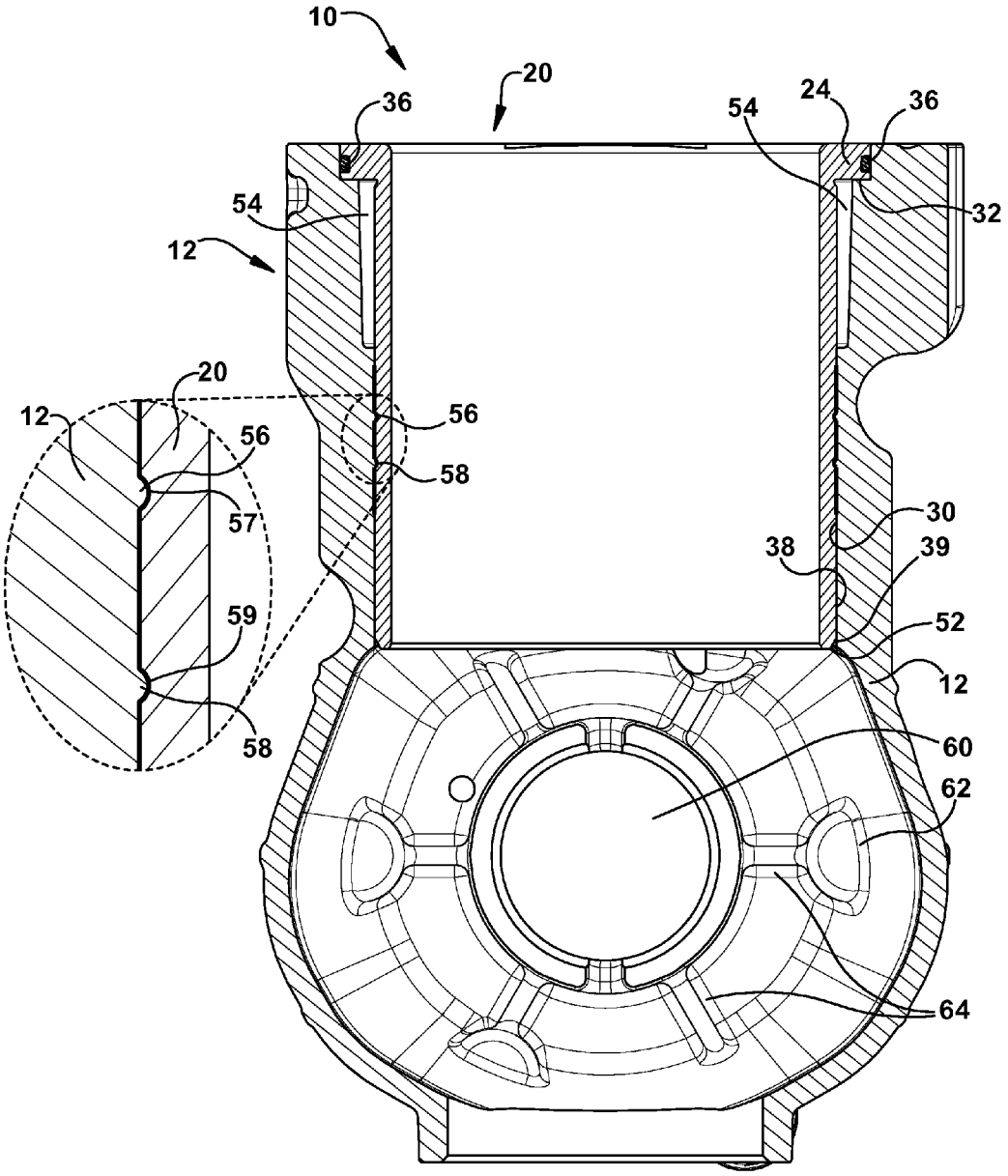
FIG. 4 is a cross-sectional view of the crankcase assembly of FIG. 1, taken along lines 4-4, according to an example of the present invention.

FIG. 4 is a cross-sectional view of the crankcase assembly of FIG. 1 and crankcase liner 20 which has been inserted into crankcase 12, according to an aspect of the present invention. Beveled surface 38 of crankcase liner 20 is seated against crankcase shoulder 52 which, along with flange 24 provides for a positive stop for crankcase liner inside crankcase housing. As mentioned above, crankcase assembly 12 has a "wet liner" and fluid passageway 54 is formed between the crankcase and crankcase liner and is sealed. In the example shown in FIG. 4, fluid passageway 54 is formed or bounded by the liner flange 24, the liner body 26 and crankcase 12. During operation, outer surface 38 of liner 20 (a "wet liner") contacts coolant fluid flowing in fluid passageway 54 and also contacts protrusions 56, and optional protrusion 58 of crankcase 12.

Protrusion 56 and optional protrusion 58 are integral with the crankcase 12 and extend radially outward from internal surface 30 of crankcase 12. In one aspect of the present invention, protrusion(s) 56, 58 are thermal protrusions formed during the assembly of crankcase assembly 10. Crankcase 12 which contains aluminum expands due to thermal expansion during temperature elevation in the assembly process. The thermal expansion of the crankcase material allows formation of protrusions 56, 58 along inner surface 30 of crankcase 12 where there is less resistance opposite to grooves 40, 42 compared to the resistance presented by outer surface 28 of liner 20. Protrusion 56 and optional protrusion 58 of crankcase 12 are at least partially disposed within groove 40, and optionally groove 42, respectively, of the crankcase liner.

In another aspect, protrusion 56 and optional protrusion 58 of crankcase 12 are in contact with grooves 40 and optional groove 42, respectively of liner 20. That is, an edge of groove(s) 40, 42 can overlap at least a portion of protrusion(s) 56, 58 and create interference between internal surface 30 of crankcase 12 and outer surface 28 of liner 20. It is not necessary that protrusion(s) 56, 58 fill the entire area of groove(s) 40, 42. In another example as shown in FIG. 4, protrusions 56 or 58 both can substantially conform to the shape of grooves 40 and 42, respectively, such that there is essentially no clearance or gap between the crankcase 12 and crankcase liner at the protrusions. That is, the shape or contours of protrusions 56 and 58 have substantially the same shape of the grooves at interfaces 57 and 59, respectively, between the crankcase 12 and the crankcase liner 20. Protrusions 56 and 58 are located a distance below fluid passageway 54 and effectively prevent liquid flow between crankcase 12 and liner 20 beyond the protrusion(s) and groove(s). The presence of liquid coolant in the crankshaft area is avoided where contact with the engine oil system can bind the bearings in the crankshaft, thus making the compressor inoperable.

Still referring to FIG. 4 in another aspect of the present invention, any of the example crankcase assemblies 10 described above can include adhesive 50. Adhesive 50 can include any of the adhesives described above, for example a cured adhesive, and is present at the interface 57 and 59 between crankcase 12 and liner 20, to ensure a proper seal. The seal of protrusion(s) 56, 58, against grooves 40, 42, prevents leakage of liquid coolant to the base area of liner 20 and beyond. Adhesive can be applied such there is essentially no clearance or gap between the crankcase 12 and crankcase liner 20 at protrusions 56, 58, however, in another example assembly a gap is present between protrusions 56, 58 and grooves 40, 42, respectively.

Figure 5:
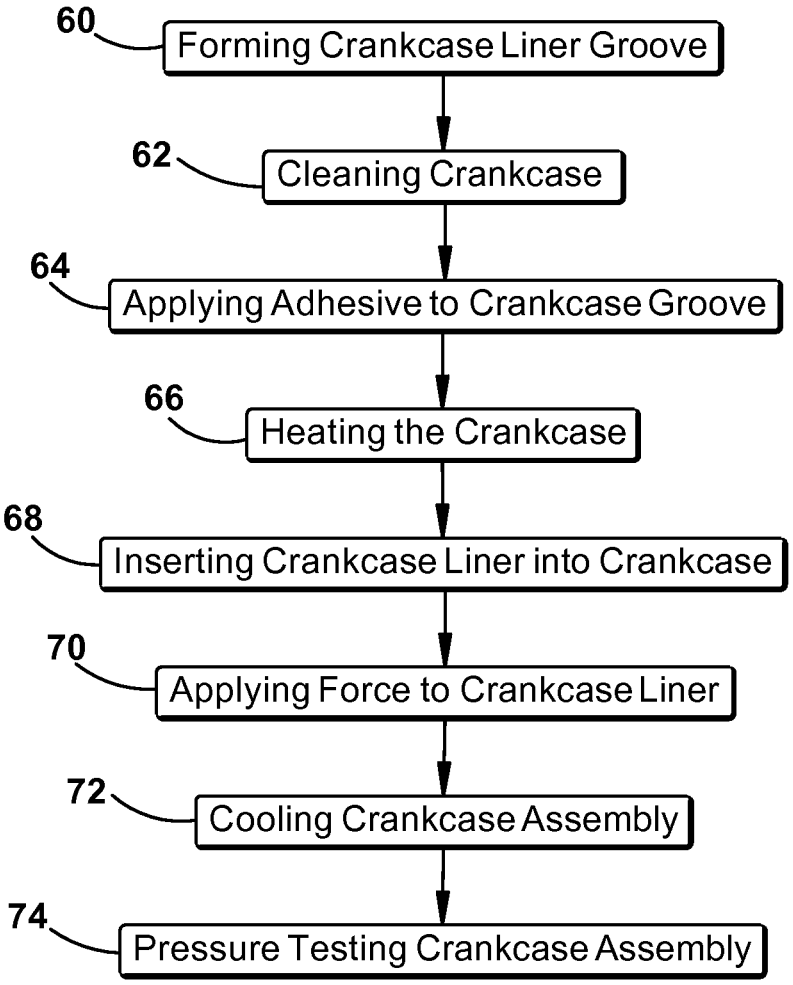
FIG. 5 is a flow chart representation of a method of producing a compressor crankshaft assembly, according to example of the present invention.

In accordance with another aspect of the present invention, a method for producing a lightweight compressor crankcase assembly is described in reference to the flow chart of FIG. 5. Referring to box 60 a groove 40 is formed into the outer surface 38 of the crankcase liner 20. Once the groove is formed, it is optional that the surface of the groove be roughened to promote better sealing of the crankcase 12 and crankcase liner 20. At box 62, another optional step is cleaning the outer surface 38 of the crankcase liner 20, and surfaces of groove 40. Cleaning the outer surface of crankcase 12, by various methods can promote improved sealing between the crankcase and liner and along groove 40. Several solvents can be used for cleaning and an example of a suitable solvent is alcohol.

At box 66, the method further provides for heating the crankcase 12, for example to a temperature such that at least a portion of the crankcase is able to expand through thermal expansion. Heating the crankcase may be accomplished by several procedures, for example, heating the crankcase 12 in an oven or placing an electric induction coil inside bore or opening 28. The temperature of the crankcase can vary depending upon the exact composition of the material, and should be greater than about 250° F., in another example greater than about 250° F. and less than 500° F., in another example, from about 275° F. to about 400° F., and in another example, from about 290° F. to about 325° F. Once the crankcase 12 is heated to the proper temperature the diameter, $D_C$, (FIG. 1) of crankcase opening 28, which is smaller than the diameter of liner, $D_L$, in its pre-assembly state, expands and becomes greater than the diameter of liner, $D_L$, upon heating. Referring to box 68, the crankcase liner 20 is aligned with crankcase opening 28 and inserted into the heated crankcase 12. The outer wall 38 of the liner 20 is placed in contact with inner wall 30 of crankcase 12. Crankcase liner 20 does not require heating and can remain at ambient temperature, for example. The contact pressure between inner surface 30 of crankcase 12 and outer surface 38 of liner 20 as the heated crankcase reverts back to its smaller, pre-assembled size, (e.g. where $D_C$ is smaller than $D_L$) results in the formation of protrusions 56, 58 (FIG. 4) along inner surface 30 of crankcase 12 and opposite groove(s) 40, 42 of liner 20. As described above with respect to FIG. 4, protrusion(s) 56, 58, contact groove(s) 40, 42 and extend at least partially within groove(s) 40, 42.

Optionally, force can be applied to the liner 20 as depicted at step 70, during or after the liner is placed inside crankcase 12 and this can be done in conjunction with cooling of the crankcase in step 72. For example, force can be applied to flange 24 of liner 20. Once assembled, another optional step is testing fluid passageway 54 for leaks via pressure testing using pressurized air or water. For example air pressure at 80 psi can be applied to fluid passageway 54 to test for a proper seal. Accordingly, in one example, a method for producing a crankcase assembly includes: forming a groove in the outer surface 38 of crankcase liner; heating the crankcase comprising aluminum; placing the crankcase liner into the opening of the crankcase such that the outer surface of the crankcase is placed into contact with the inner surface of the crankcase.

In another aspect, any of the various methods described above can further include applying adhesive to the groove of crankcase liner 20 prior to placing the crankcase liner 20 into crankcase 12. In one method for example, adhesive is applied, box 64, at least to the groove(s) and can also be applied to portions of outer surface 38 of the crankcase liner. An example of adhesive is an anaerobic adhesive discussed above. Accordingly, in one example, a method for producing a crankcase assembly includes: forming a groove in the outer surface 38 of crankcase liner; applying adhesive to the outer surface of the crankcase liner; heating the crankcase comprising aluminum; placing the crankcase liner into the opening of the crankcase such that the outer surface of the crankcase is placed into contact with the inner surface of the crankcase and forming an interference between the crankcase and crankcase liner.

Any of the various example methods described above can include forming a second groove 42 in the outer surface 38 of the crankcase liner 20. The second groove 42 can be the same size or a different size than groove 40. Also, in any of the above methods, the seal between the crankcase protrusion 56, and optionally protrusion 58, and liner 20 can be pressure tested to ensure an airtight seal.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A compressor crankcase assembly, comprising:

a crankcase made of a first material comprising at least 50% by weight aluminum;

a crankcase liner disposed within the crankcase and having a groove along an outer surface of the crankcase liner;

a protrusion of the crankcase which extends radially outward from an internal surface of the crankcase and which is at least partially disposed within the groove of the crankcase liner; and wherein the groove of the crankcase liner is substantially perpendicular to the longitudinal axis of the crankcase liner.

2. The compressor crankcase assembly of claim 1, wherein the groove of the crankcase liner is located along a central portion of the crankcase liner between a flange of the crankcase liner and a base of the crankcase liner.

3. The compressor crankcase assembly of claim 1, comprising an adhesive that contacts the groove of the crankcase liner and the protrusion of the crankcase.

4. The compressor crankcase assembly of claim 3, wherein the adhesive is an anaerobic adhesive.

5. The compressor crankcase assembly of claim 3, wherein the adhesive layer is an anaerobic adhesive comprising acrylic polymer compounds.

6. The compressor crankcase assembly of claim 1, wherein the crankcase and crankcase liner form a fluid passageway therebetween.

7. The crankcase assembly of claim 6, wherein the groove of the crankcase liner extends along the perimeter of the liner body between the fluid passageway and a base area of the liner.

8. The compressor crankcase assembly of claim 6, wherein the fluid passageway is sealed.

9. The compressor crankcase assembly of claim 6, wherein the fluid passageway is bounded by a flange of the crankcase liner, the body of the crankcase liner and the crankcase.

10. The compressor crankcase assembly of claim 1, comprising a second groove along the outer surface of the crankcase liner, wherein the second groove is in contact with a second protrusion of the crankcase.

11. The compressor crankcase assembly of claim 1, wherein the crankcase liner is cast iron.

12. The compressor crankcase assembly of claim 1, wherein the crankcase is made of a material that comprises at least 50% by weight aluminum and the crankcase liner is made of a material that comprises at least 50% iron.

13. The compressor crankcase assembly of claim 12, wherein the crankcase assembly comprises an anaerobic adhesive that contacts the groove of the crankcase liner and the protrusion of the crankcase.

14. The compressor crankcase assembly of claim 1, wherein the crankcase is made of a material that comprises at least 85% by weight aluminum and the crankcase liner is made of a material that comprises at least 50% by weight iron.

15. The crankcase assembly of claim 1, wherein the groove of the crankcase liner extends along the perimeter of the outer surface of the liner body.

16. The crankcase assembly of claim 1, wherein the groove of the crankcase liner is circumferential about the outer surface of the liner.

17. A compressor crankcase assembly, comprising:

a crankcase made of a first material comprising at least 50% by weight aluminum;

a crankcase liner disposed within the crankcase and having a groove along an outer surface of the crankcase liner;

a protrusion of the crankcase that is at least partially disposed within the groove of the crankcase liner; and wherein the protrusion of the crankcase is a heat formed protrusion disposed along the inner surface of the crankcase.

18. A compressor crankcase assembly comprising:

a crankcase made of a first material comprising at least 50% by weight aluminum, the crankcase having a protrusion which extends radially outward from the internal surface of the crankcase;

a crankcase liner disposed within the crankcase, the crankcase liner having a body and a groove therein which extends along the perimeter of the body of crankcase liner, the crankcase liner;

a fluid passageway disposed between crankcase and crankcase liner; and wherein the protrusion of the crankcase is at least partially disposed within the groove of the crankcase liner along the body between the fluid passageway and a base of the crankcase liner.

19. A method for producing a crankcase assembly comprising:

forming a groove in the outer surface of crankcase liner;

heating the crankcase comprising a material that comprises at least about 50% by weight aluminum;

placing the crankcase liner into the crankcase such that the outer surface of the crankcase liner is placed into contact with an inner surface of the crankcase; and forming a protrusion that extends radially outward along the inner surface of the crankcase such that the protrusion extends at least partially inside the groove of the crankcase liner.

20. The method of claim 19, wherein the groove is applied circumferentially to the central portion of the liner body.

21. The method of claim 19, comprising:

applying adhesive to the groove of the crankcase liner prior to placing the crankcase liner into the crankcase.

22. The method of claim 20, wherein the adhesive is an anaerobic adhesive comprising methacrylate.

23. The method of claim 19, wherein crankcase assembly comprises a fluid passageway between the crankcase and the crankcase liner.

24. The method of claim 19, wherein the crankcase liner comprises at least 50% iron.

* * * * *